US005318140A

United States Patent [19]

Ekwall et al.

[11] Patent Number: 5,318,140

[45] Date of Patent: Jun. 7, 1994

[54] FLUID OPERATED DRILL APPARATUS

[75] Inventors: Berndt Ekwall, Saltsjöbaden; Torbjörn Jakobsson, Saltsjö-Boo; Martin Peterson, Nacka, all of Sweden

[73] Assignee: Uniroc AB, Fagersta, Sweden

[21] Appl. No.: 992,247

[22] Filed: Dec. 14, 1992

[30] Foreign Application Priority Data

Dec. 20, 1991 [SE] Sweden ..... 9103792-9

[51] Int. Cl.[5] ..... E21B 4/14

[52] U.S. Cl. ..... 175/296; 175/298; 173/78; 173/80

[58] Field of Search ..... 175/293, 295, 296, 297

[56] References Cited

U.S. PATENT DOCUMENTS

| | | | |
|---|---|---|---|
| 2,837,317 | 6/1958 | Hulshizer | 175/296 |
| 2,937,619 | 5/1960 | Kurt | 175/296 |
| 2,951,467 | 9/1960 | Morrison | 175/296 |
| 3,095,047 | 6/1963 | Fleischer et al. | 175/296 |
| 3,379,261 | 4/1968 | Martini | 175/296 |
| 3,692,122 | 9/1972 | Curington | 175/296 |
| 4,819,746 | 4/1989 | Brown et al. | 175/296 |
| 4,958,691 | 9/1990 | Hipp | 175/296 |
| 5,139,096 | 8/1992 | Lister | 175/296 |

*Primary Examiner*—Ramon S. Britts
*Assistant Examiner*—Frank S. Tsay
*Attorney, Agent, or Firm*—Mark P. Stone

[57] ABSTRACT

Down-the-hole drill comprising a housing (1), a hammer piston (6) movable to-and-fro in the housing and intended for impacting a drill bit (5). A back piece (3) provided with an extension (12) with a valve part (17) cooperates with a part (8) of a central channel in the hammer piston. This part of the central channel comprises a zone (16) with larger diameter than adjacent parts at an intermediate part of this part. This results in that pressure medium can pass the valve part when it is situated at the zone and that the valve part and the hammer piston sealingly cooperate when the valve part is on either side of the zone.

4 Claims, 4 Drawing Sheets

FLUID OPERATED DRILL APPARATUS

BACKGROUND OF THE INVENTION

The present invention relates to a down-the-hole drill of the kind where the movement of the hammer piston controls the supply of pressure medium to the forward and rearward end surfaces of the hammer piston for the driving of the hammer piston in a to-and-fro movement.

In a prior art down-the-hole drill of the above mentioned kind, see DE-A 36 28 327, the chamber divider is provided with a cutout whose function is to increase the volume of the chamber so that the pressure increase during the return stroke of the hammer piston is decreased. A drawback with this design of the down-the-hole drill is that the impact frequency becomes comparatively low and that the risk that the hammer piston hits the chamber divider becomes comparatively high. Furthermore, the air consumption becomes relatively high.

SUMMARY OF THE INVENTION

The present invention aims at achieving a down-the-hole drill where the impact frquency and the impact energy are higher than in prior art down-the-hole drills. Furthermore, the invention aims at achieving a down-the-hole drill where the amount of pressure medium needed is comparatively low in relation to the output power of the machine.

BRIEF DESCRIPTION OF THE DRAWINGS

The invention is exemplified below with reference to the accompanying drawings in which.

DESCRIPTION OF THE BEST MODES FOR CARRYING OUT THE INVENTION

Figure 1:
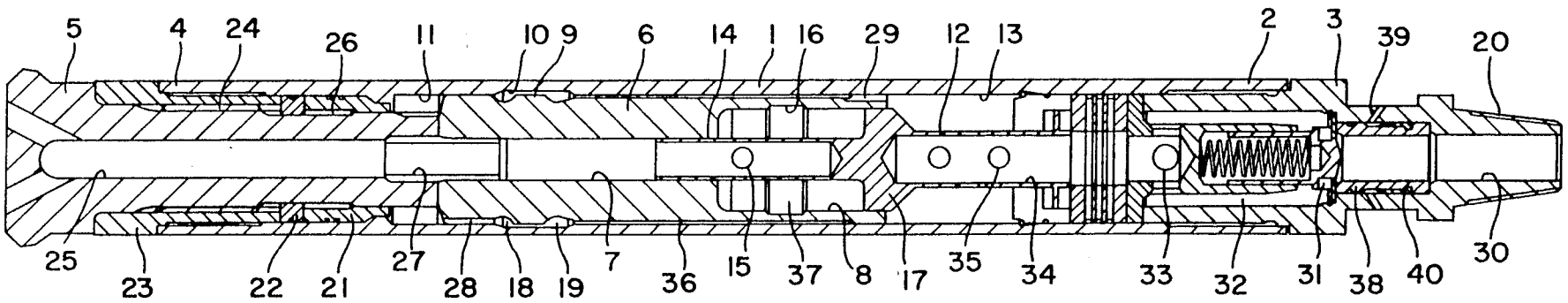
FIG. 1 shows a section through a first embodiment of a down-the-hole drill according to the invention with the hammer piston in impact position.
Figure 2:
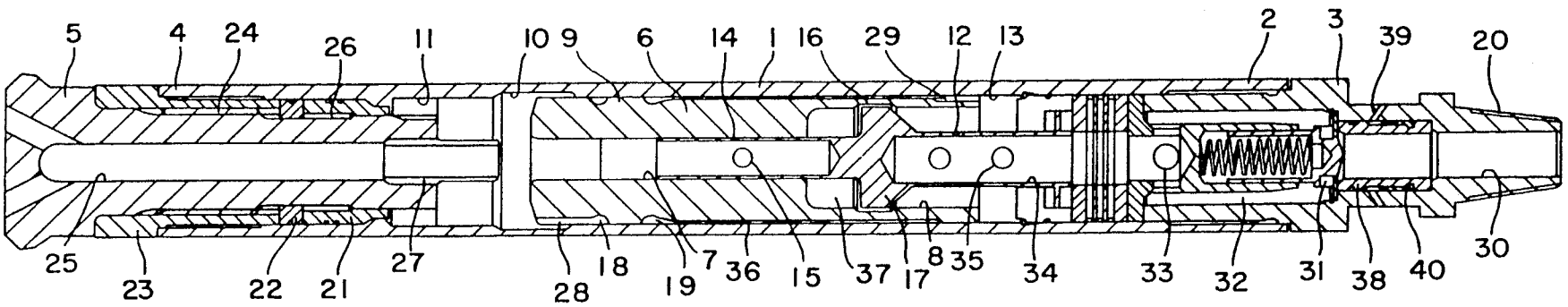
FIG. 2 shows a section with the hammer piston in position for supply of pressure medium to the rear drive surface of the hammer piston.
Figure 3:
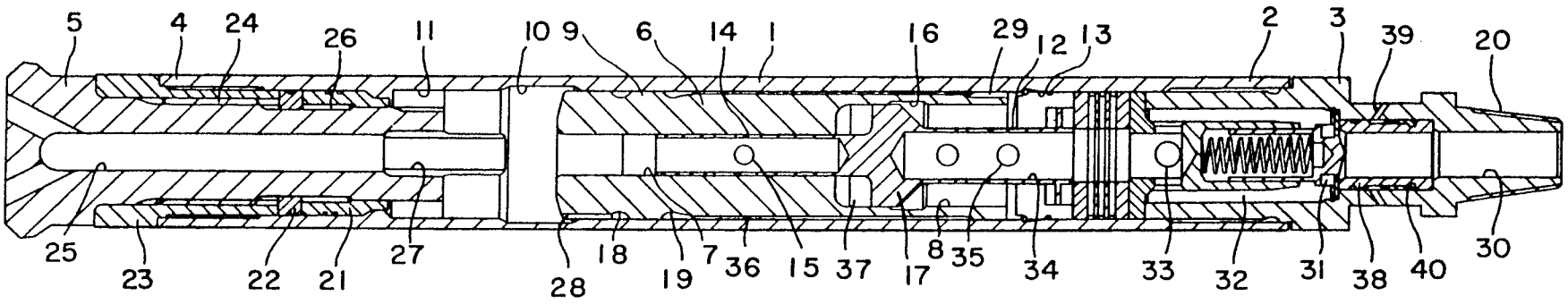
FIG. 3 shows a section with the hammer piston in position with confined rear pressure medium volume.

The down-the-hole drill according to FIGS. 1–3 comprises a housing 1 provided with a rear end 2 and a front end 4. At the rear end a back piece 3 is arranged for connection of the down-the-hole drill to a not shown tube string. The back piece is for this purpose provided with a thread 20. At the front end a drill bit 5 is arranged. The drill bit is provided with a flushing channel 25 and a diameter reduction 26. The drill bit 5 is guided by bushings 21 and 23 and prevented from falling out of the down-the-hole drill by a stop ring 22. Bushing 23 is screwed into housing 1. The rotation of the not shown tube string is transferred via housing 1 and a splines connection 24 to the drill bit 5. The drill bit is provided with a tube piece 27 which together with the hammer piston 6, movable to-and-fro in housing 1, forms a foot valve. The housing 1 is provided with a cutout 10 for cooperation with an annular section 9 on the hammer piston. The hammer piston is on each side of the annular section provided with a turndown 18 and 19 respectively. At the front end of the hammer piston 6, which has the same diameter as the annular section 9, the hammer piston is provided with a number of grooves 28 distributed around the periphery of the hammer piston. In the same way the rear end of the hammer piston, which has the same diameter as the annular section 9, is provided with grooves 29. The hammer piston is internally provided with a central channel which comprises a first part 7 with a first diameter and a second part 8 with larger diameter. The second part of the central channel comprises a zone 16 with larger diameter than the other parts of the second part 8. This zone is situated at an intermediate part of the second part. Through this the hammer piston can sealingly cooperate with a valve part 17 on an extension 12 on the back piece 3 when the valve piece 17 is situated on either side of the zone 16 and allow passage of pressure medium when the valve part 17 is at the zone 16. Pressure medium for the driving of the down-the-hole drill is supplied via channel 30, check valve 31, chamber 32, holes 33, channel 34 and holes 35 to a second chamber 13 which is arranged about the extension 12 and during operation continuously pressurized. Chamber 13 is continuously connected with the turndown 19 via the grooves 29 and the slot 36 between the hammer piston 6 and the housing 1. A first chamber 11 situated in front of the hammer piston is continuously connected with the turndown 18 via the grooves 28. The extension is provided with a tube formed part 14 which extends into the first part 7 of the central channel in the hammer piston. The tube formed part is provided with holes 15 which form pressure medium connection between the second part 8 and the first part 7 when the hammer piston is situated in the position shown in FIG. 1. This pressure medium connection is controlled by the hammer piston 6 which in the positions shown in FIGS. 2 and 3 prevents pressure medium from passing through the holes 15. Because the tube formed part 14 all the time extends into the first part 7 of the central channel the risk of damaging the tube formed part and the hammer piston 6 is decreased. Back piece 3 comprises a sleeve 38 about which a ring 40 of elastic material is arranged and holes 39. At certain drilling conditions it is desirable to supply flushing medium at the rear end of the down-the-hole drill. In such a case one can provide sleeve 38 with radial holes under the elastic ring 40 which then will operate as a check valve.

The down-the-hole drill shown in FIGS. 1–3 works in the following way. In the position shown in FIG. 1 first chamber 11 is pressurised via grooves 29, slot 36, cutout 10 and grooves 28. The turndowns 18,19 have as function to speed up the driving medium flow when the passage via cutout 10 is opened during the forwards movement of hammer piston 6. The room 37 is via the holes 15, the first part 7 of the central channel and the flushing channel 25 connected to the surrounding pressure. This gives as result that the hammer piston is driven backwards towards the position shown in FIG. 2. In the position shown in FIG. 2 the hammer piston has left the tube piece 27 so that the first chamber 11 is connected with the flushing channel 25 and thus with the surrounding pressure. The valve part 17 on the extension 12 is situated at the zone 16 so that pressure medium can pass from the second chamber 13 to the room 37. Furthermore, the hammer piston 6 has closed the pressure medium connection via holes 15. Through this the backwards movement of the hammer piston 6 is braked. This braking is amplified when the zone 16 of the hammer piston has passed the valve part 17 as shown in FIG. 3. In this position the pressure in the closed room 37 increases rapidly. Through this it is achieved that the hammer piston rapidly turns forward which makes a high working frequency possible with maintained high impact energy in the single impacts against the drill bit 5. The possibilities of increasing the working frequency are amplified by the speeding up of the pressure medium flow which is obtained by the turndowns 18,19. Because of the braking of the backwards movement of the hammer piston by means of pressure medium cushion in room 37 which stores energy which can be used in the subsequent forwards movement the amount of pressure medium used by the machine is decreased. Furthermore, the risk of the hammer piston hitting the valve part 17 decreases.

Figure 4:
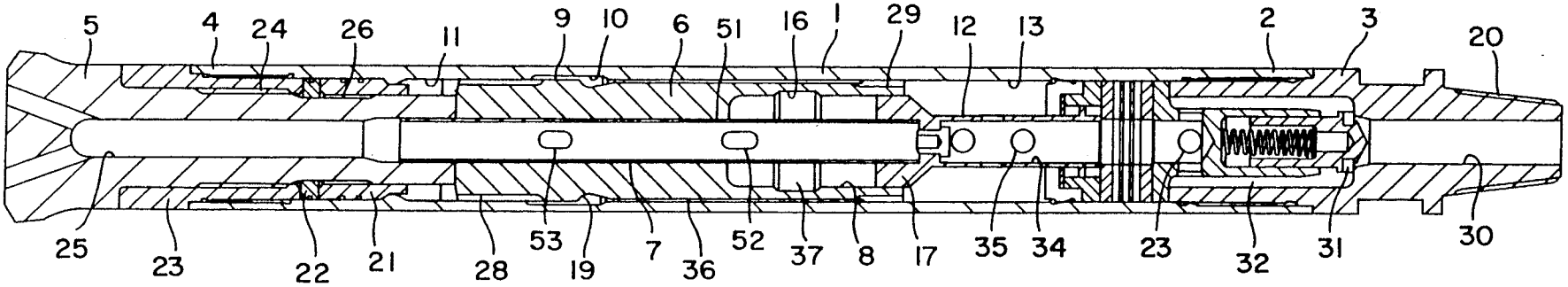
FIG. 4 shows a section through a second embodiment of a down-the-hole drill according to the invention.

The embodiment of the invention shown in FIG. 4 differs from that of FIGS. 1–3 in that the tube formed part 14 and the tube piece 27 have been replaced by a continuous tube 51 provided with holes 52 and 53. Holes 52 correspond to holes 15 in the embodiment according to FIGS. 1–3. Holes 53 constitute a pressure medium connection, controlled by the hammer piston 6, between the first chamber 11 and the flushing channel 25. Because the tube 51 continuously extends into the drill bit 5 the risk for damage on tube 51 and drill bit 5 is decreased. The hammer piston 6 according to the embodiment according to FIG. 4 is provided with a turndown 19 behind the annular section 9. This turndown is the most important for speeding up the pressure medium flow passing the annular section 9. Also according this embodiment one can provide the hammer piston with a turndown in front of the annular section 9 as in the embodiment according to FIGS. 1–3.

We claim:

1. A fluid operated drill apparatus comprising a housing (1), a rear element (3) mounted to a rear end (2) of the housing, a drill bit (5) mounted to a front end 94) of the housing and a hammer piston (6) reciprocally movable within the housing for impacting against an end of said drill bit as said hammer piston moves in a direction towards said front end of said housing, the hammer piston defining a central channel which at its end towards the drill bit has a first part (7) with a first diameter and at its end towards the rear element has a second part (8) with a larger diameter than said first part, the hammer piston including an annular section (9) which is movable together with said hammer piston relative to a cutout (10) in the housing for controlling the supply of a pressure medium to a first chamber (11) situated in front of the hammer piston, the rear element (3) having an extension (12) extending from said rear element in a direction towards said front end for controlling the supply of said pressure medium to said central channel from a second chamber (13) situated about the extension and continuously pressurized during operation, said second part (8) comprising an intermediate portion disposed between two end portions of said second part, said intermediate portion comprising a zone (16) having a larger diameter than said end portions, said extension 912) having a valve element (17) mounted thereto such that said pressure medium passes said valve element (17) when said zone passes the valve element, said valve element (17) and said second part (8) cooperating to prevent said pressure medium from passing said valve element when the valve element is situated on either side of said zone (16).

2. The drill apparatus according to claim 1, wherein said extension (12) comprises a tubular element (14) which extends into said first part (7), said tubular element defining a radial hole (15) for permitting flow of said pressure medium between said second (8) and said first (7) parts, said hammer piston controlling the flow of said pressure medium through said hole by selectively blocking said hole.

3. The drill apparatus according to claim 1, wherein the hammer piston (6) on either side of said annular section (9) defines a lesser diameter piston section (18, 19).

4. The drill apparatus according to claim 2, wherein the hammer piston (6) on either side of said annular section (9) defines a lesser diameter piston section (18, 19).

* * * * *